US011320845B2

(12) United States Patent
McFetridge et al.

(10) Patent No.: US 11,320,845 B2
(45) Date of Patent: May 3, 2022

(54) SMART VOLTAGE REDUCTION AND REVERSE POWER OPERATING MODE DETERMINATION FOR LOAD TAP CHARGING TRANSFORMERS AND VOLTAGE REGULATORS

(71) Applicant: Beckwith Electric Co., Inc., Largo, FL (US)

(72) Inventors: Robert McFetridge, Middlesex, NC (US); Murty Yalla, Largo, FL (US)

(73) Assignee: Beckwith Electric Co., Inc., Largo, FL (US)

( * ) Notice: Subject to any disclaimer, the term of this patent is extended or adjusted under 35 U.S.C. 154(b) by 428 days.

(21) Appl. No.: 14/584,791

(22) Filed: Dec. 29, 2014

(65) Prior Publication Data

US 2015/0185743 A1 Jul. 2, 2015

Related U.S. Application Data

(60) Provisional application No. 61/921,122, filed on Dec. 27, 2013, provisional application No. 61/921,104, filed on Dec. 27, 2013, provisional application No. 61/921,109, filed on Dec. 27, 2013.

(51) Int. Cl.
*G05F 1/10* (2006.01)

(52) U.S. Cl.
CPC ..... *G05F 1/10* (2013.01)

(58) Field of Classification Search
None
See application file for complete search history.

(56) References Cited

U.S. PATENT DOCUMENTS 4,672,298 A * 6/1987 Rohatyn ..... G05F 1/70 323/208
5,602,462 A * 2/1997 Stich ..... G05F 1/147 307/64

* cited by examiner

*Primary Examiner* — Mohammad Ali
*Assistant Examiner* — Saad M Kabir
(74) *Attorney, Agent, or Firm* — Michael Best & Friedrich LLP

(57) ABSTRACT

A system for using load tap changing (LTC) transformers and voltage regulators (VR) to reduce the voltage in a power transmission system by temporarily disabling the upper band voltage and temporarily designating the bandcenter as the upper band edge voltage whereby the tap selector switches operate in set increments to reduce applied voltage to a level that is between the redesigned bandcenter and the lower band edge.

4 Claims, 3 Drawing Sheets

SMART VOLTAGE REDUCTION AND REVERSE POWER OPERATING MODE DETERMINATION FOR LOAD TAP CHARGING TRANSFORMERS AND VOLTAGE REGULATORS

CROSS-REFERENCE TO RELATED INVENTIONS

This application claims the benefit of pending provisional application Ser. No. 61/921,104 filed on Dec. 27, 2013 entitled "Smart Voltage Reduction with Positive Compensation." This application also claims the benefit of pending provisional application Ser. No. 61/921,109 filed Dec. 27, 2013 entitled "Smart Reverse Power." This application further claims benefit of pending provisional patent application Ser. No. 61/921,122 entitled "Smart voltage Reduction Band Altering." The contents of all these applications are incorporated herein by reference for all purposes.

BACKGROUND OF THE INVENTION

1. Field of the Invention

This invention relates to a system and method for accurately reducing voltage in a load tap changing transformer (LTC) and voltage regulators (VR). The invention further relates to a system and method for automatically determining operating mode when a LTC transformer/VR is experiencing reverse power.

2. Description of the Background Art

Presently, Load tap changing (LTC) transformers and voltage regulators (VR) are used in a variety of electric power systems. LTCs and VRs are used to maintain system voltage at a predetermined value. LTC transformers and VRs are equipped with tapchangers which, in turn, are fitted with tap selector switches. LTC and VR controllers provide means to change tap selector switches to a point of contact where a desired voltage is achieved. For example, should the voltage in the electric power system go below a predefined value, provision is made to energize an associated motor to drive tap selector switches to make contact to a point of higher voltage. This has the effect of increasing the system voltage. Should the voltage go above a predefined value the motor is energized to drive the tap selector switches to make contact with a point of lower voltage. This has the effect of lowering the system voltage.

However, some system emergencies results in an interruption of normal electric power generation. When this occurs the system generation is not able to meet the load demand due to loss of a major generator. Other times unusually high load demand occurs due to extreme weather. In such instances, electric power companies must apply voltage reduction to reduce the voltage by a given percentage thereby reducing the load. Traditional voltage reduction schemes never provided the amount of requested voltage reduction by reducing the bandcenter due to the use of bandwidth.

Therefore, it is an object of this invention to provide an improvement which overcomes the aforementioned inadequacies of the prior art devices and provides an improvement which is a significant contribution to the advancement of the smart voltage reduction art.

SUMMARY OF THE INVENTION

It is therefore an object of the present disclosure to provide means for more accurately reducing the voltage in a power distribution system.

Another object of this invention is to provide a means for smart voltage reduction in LTC transformers and voltage regulators Another object of this invention is to provide a system for determining the operating mode in LTC transformers and voltage regulators during reverse power operation.

Finally it is an object of the present disclosure to provide a method for effectively responding to varying demands in a electric power generation, transmission and distribution system.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present disclosure relates to a system for using load tap changing (LTC) transformers and voltage regulators (VR) to more accurately reduce the voltage in a power transmission and distribution system. It further relates to a system for determining the operating mode for LTC transformers and VRs. Corresponding methods are also disclosed. The various components of the present system, and the manner in which they interrelate, are more fully described hereinafter.

Smart Voltage Reduction

Figure 1:
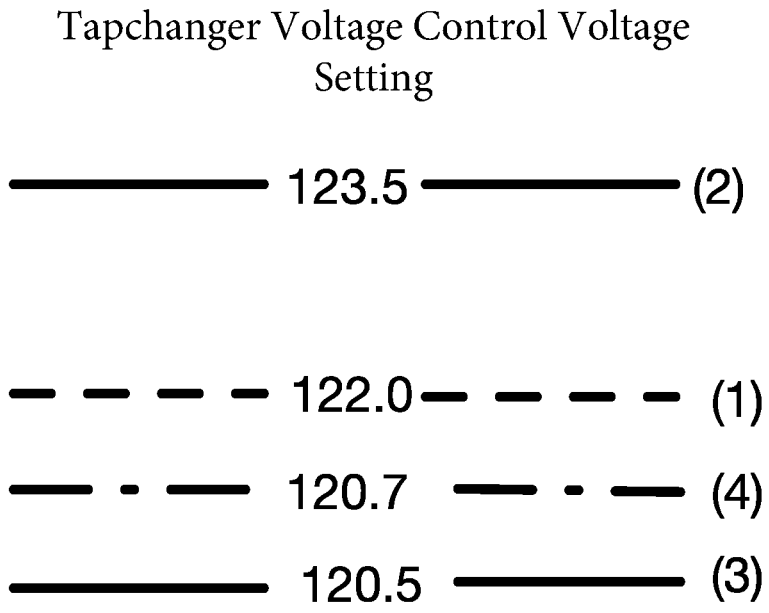
FIG. 1 is a plot of the voltage control settings of a tapchanger controller.

FIG. 1 is a graph depicting an example of the control settings of a tapchanger. Reference 1 is the bandcenter at 122 volts; reference 2 is the upper band edge at 123.5 volts; reference 3 is the lower band edge at 120.5 volts. The measured voltage is referenced by 4 at 120.7 volts. The difference in voltage between the upper band edge at 2 (123.5 V) and the lower band edge at 3 (120.5 V) is called the bandwidth setting. In this example the bandwidth setting is 3 volts. In this example, a tapchanger having ±16 taps (total of 33 taps including the neutral) with an approximate voltage transformer secondary voltage per tap of 0.75 V is used. The bandcenter 1 and bandwidth settings are programmed in the LTC/VR control. These settings can be entered either through a front panel using switches and the LCD display or using a software communications program which communicates with the LTC/VR controller. From the bandcenter and bandwidth settings the LTC/VR controller, which is equipped with a microprocessor and memory, calculates the upper band edge 2 using the formula (bandcenter+bandwidth/2) and the lower band edge 3 using the formula (bandcenter−bandwidth/2).

Figure 2:
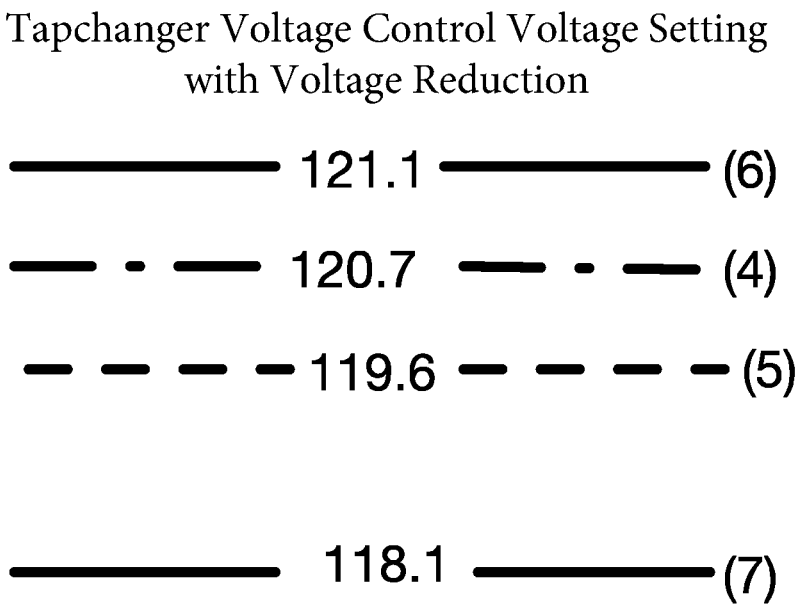
FIG. 2 is a plot of the voltage control settings of a tapchanger controller with voltage reduction.

The voltage reduction is achieved by reducing the bandcenter by a given percentage but keeping the bandwidth the same as before (3 V). Voltage reduction command which can come from various sources such as front panel using switches and LCD display, closure of a contact input indicating voltage reduction command or a command sent over a communications port from a software program such as distribution management system (DMS). As an example a 2% voltage reduction command from settings in FIG. 1 gives the new settings, bandcenter 5 (119.6 V which is 2% below the previous bandcenter of 122 V), upper band edge 6 (121.1 V), and a lower band edge 7 (118.1 V). These values are shown in FIG. 2.

As the measured voltage is within the upper 6 and lower 7 band edges the LTC/VR controller will not send any commands to reduce the voltage and as a result the voltage reduction will not take place. If the requested voltage reduction is 3% then the upper band edge would be 119.9 V which is below the measured voltage of 120.7 V. In this case the LTC/VR controller will command the tapchanger to make one tapchange which will bring the voltage close to the upper band edge and will not make any further tapchanges. Even though the requested voltage reduction is 3% (3.7 V) the actual reduction received is 0.75 V (0.6%). Thus, this voltage reduction scheme gives much less percentage voltage reduction than the requested percentage voltage reduction.

Consequently, by way of the present system, accurate voltage reduction can be achieved. Namely, voltage reductions that are closer to the requested percentage reduction can be readily achieved.

Figure 3:
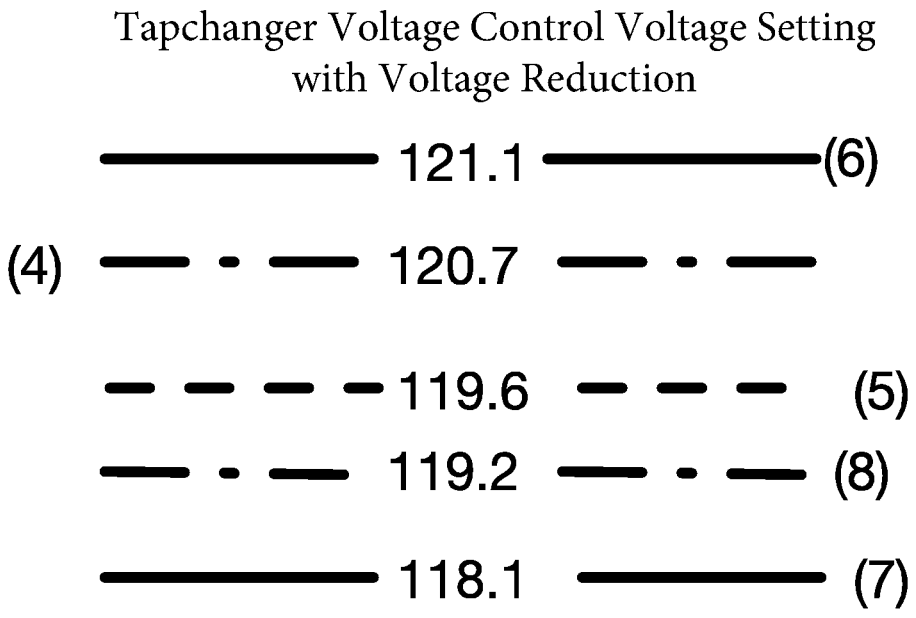
FIG. 3 is a plot of the voltage control settings of a tapchanger controller with voltage reduction.

Referring to FIG. 3, when a voltage reduction command is sent to the LTC/VR controller the inventive technique implemented in the controller temporarily disables the new upper band edge 6 (121.1 V) and makes the new bandcenter 5 (119.6 V) as the modified upper band edge keeping the lower band edge 7 (118.1 V) the same. Since the measured voltage 4 (120.7 V) is above the modified upper band edge 5 (119.6 V) the LTC/VR controller will send lower command twice bringing the voltage below this new upper band edge 5. The final voltage 8 with two tap changes (each tapchange is 0.75 V) is around 119.2 V. Once the voltage reaches below the modified upper band edge 5 the original upper band edge 6 will be re-enabled to prevent excessive tapchanges due to reduced bandwidth (the temporary bandwidth is one half of the original bandwidth).

In the voltage reduction scheme in the above example, the voltage reduction request of 2% results in no voltage reduction (0%) and the inventive technique using smart voltage reduction brought the voltage down from 120.7 V to 119.2 V. Thus, the present system resulted in a voltage reduction of approximately 1.2%.

Figure 5:
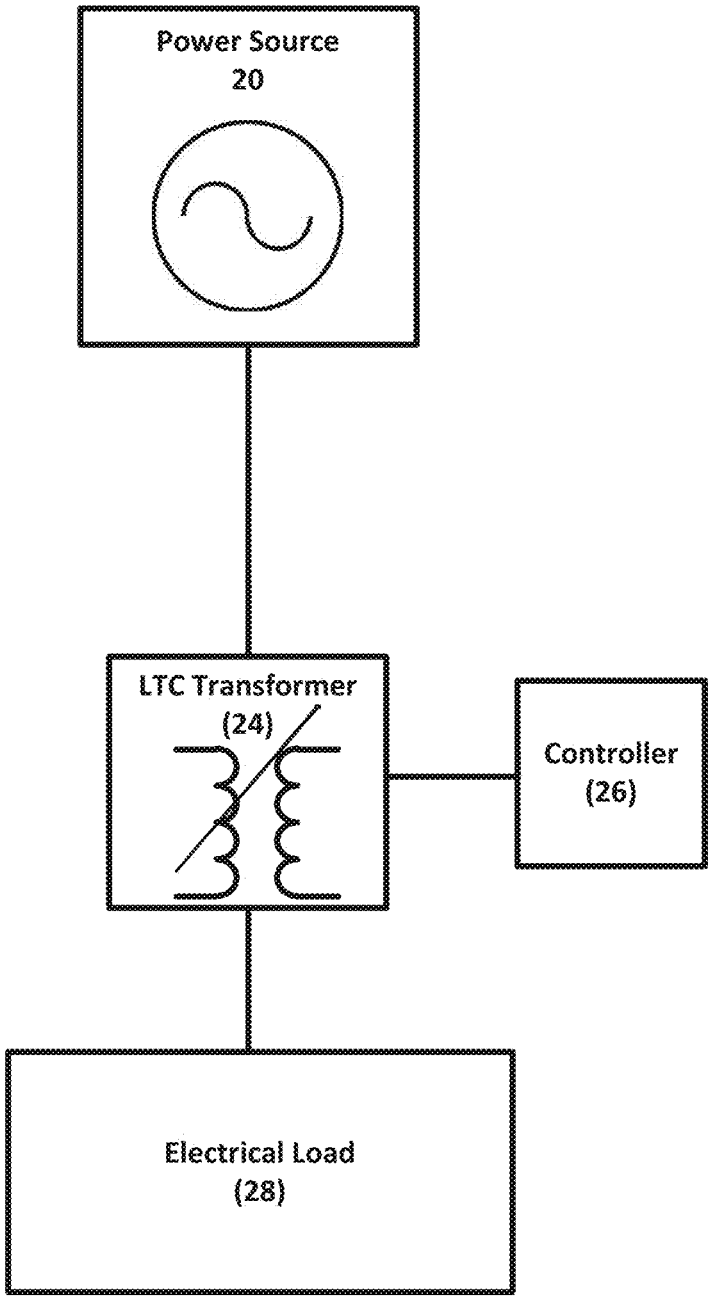
FIG. 5 is a diagram of the system of the present disclosure.

FIG. 5 is a schematic of a system used to implement the present voltage reduction scheme. As noted, the system includes a power source 20, and an LTC Transformer or a voltage regulator (VR) 24. The LTC/VR controller is noted by reference 26. The LTC/VR controller 26 comprises a microprocessor and memory where the initial bandcenter and bandwith settings are stored. The LTC/VR controller determines the upper band edge, lower band edge from the bandcenter and bandwith settings. Further LTC/VR controller 26 can temporarily disable the upper band edge and redesignate the bandcenter as the redesiganted upper band edge. Conversely, the LTC/VR controller 26 can temporarily disable the lower band edge and redesignate the bandcenter as the redesiganted lower band edge. Both techniques are employed to achieve a more accurate voltage increase or decrease from the tapchanges.

Voltage Reduction with Switched Capacitor Banks

Figure 4:
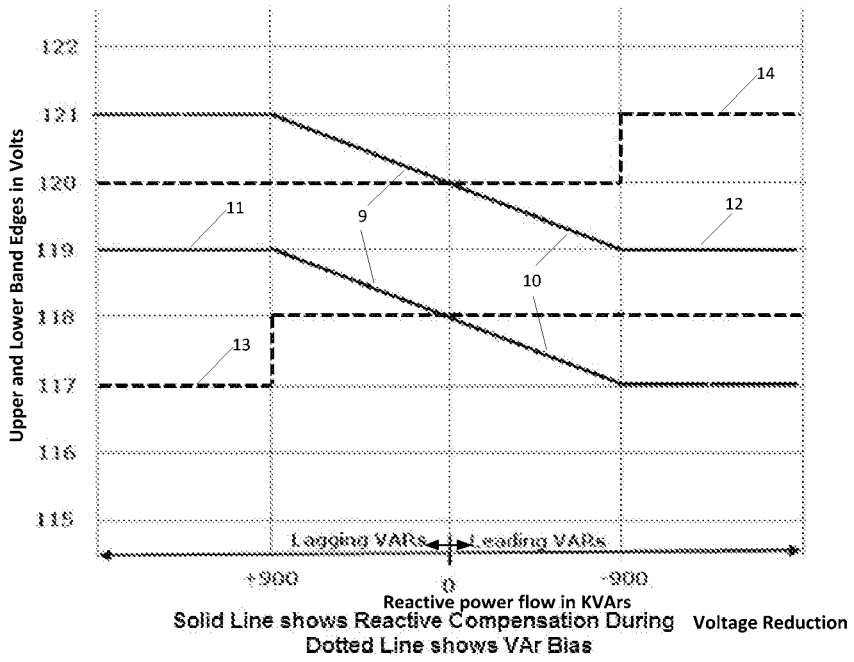
FIG. 4 is a plot of upper and lower band edges versus reactive power with positive X compensation.

When the LTC/VR controller is operating with its normal bandcenter and bandwidth settings without any voltage reduction command, utility companies generally like to run the power factor as close to unity as possible to reduce power distribution losses. This can be achieved by a technique called var bias where the lower band edge 13 (see FIG. 4) is temporarily lowered by a fixed amount of volts (example 1 V) when lagging vars above a set value are flowing through the circuit. This allows the voltage to go below the lower band edge and help the capacitor banks to switch 'on' bringing power factor close to unity and also bring the voltage above the lower band edge without the need for a tapchange operation. When power factor goes leading the upper band edge 14 is raised by a fixed amount of volts (example 1 V) to encourage downstream capacitor banks to come 'off' thereby bringing the power factor close to unity.

When the LTC/VR controller is operating with voltage reduction command the downstream voltage controlled capacitor banks, will switch 'on' to raise the voltage. This is beneficial but leads to a leading power factor. When returning to normal voltage by removing the voltage reduction, the power companies would like the power factor brought back close to unity quickly by opening some of the capacitor banks. The problem with the traditional method is that once the voltage is in-band the LTC transformer/VR regulator stops tapping between the lower band edge and the bandcenter. This voltage is typically not high enough to force the capacitor banks to open. By temporarily eliminating the lower band edge and making the bandcenter as the lower band edge when leaving voltage reduction, the voltage will reach between the bandcenter and the upper band edge. This higher voltage will then force one or more of the capacitors to open, bringing the power factor close to unity.

Applying Additional Compensation Due to Var Flow

During voltage reduction having the capacitor banks 'on' the downstream voltage will be higher. This allows the upstream LTC transformer/VR to lower the voltage further without supplying too low a voltage to downstream customers. The problem is that if the capacitor banks fail to close (due to switch or fuse failure), the downstream voltage will be lower and the upstream device has to be more conservative when reducing the voltage or customers downstream will receive low voltage.

This inventive technique (also denoted as positive reactive (X) compensation) allows the LTC/VR controller to monitor the var flow while in voltage reduction and when the var flow is leading (indicating the downstream capacitor banks are 'on') linearly shift the bandcenter and the corresponding lower and upper band edges down 10 based on the amount of leading vars. Similarly, when the var flow is lagging (indicating the downstream capacitor banks are 'off') the bandcenter and the corresponding lower and upper band edges will linearly shift up to 9 based on the var flow.

In order to avoid too low or too high a voltage on the feeder the amount of compensation can be limited (example 1 V) 11,12.

Using the inventive compensation technique during voltage reduction induces the control to lower the voltage further as the power factor goes leading and will not allow lowering the voltage as much as when the power factor is lagging. This will help increase the amount of voltage reduction and get closer to the requested amount.

Smart Reverse Power Operating Mode

Another aspect of this invention is related to the operating mode of LTC/VR controller during reverse power flow. Normal power flow through LTC transformer/VR is considered when power is flowing from the source side to the load side. However, the power can flow from load side to source side (reverse power) either due to the excess power from the distributed generation flowing back to the power system or power rerouted from the power system in the opposite direction due to the line switching from the operation of switches and reclosers. During line switching the LTC transformer/VR may be fed from the load side and the power travels from the load side to the source side. When a LTC transformer/VR makes tapchanges the voltage on the load side does not vary much but the voltage on the source side varies. In this case LTC/VR controller operates on reverse regulate mode where raise and lower tap commands are reversed by the controller.

The same scenario of reverse power flow can happen when the distribution feeder is connected with distributed Generation (DG). When the power produced by the DG exceeds the local load the excess power can be fed back to the power system. Since the strength of the DG is very low compared to the power system the voltage on the source side is dictated by the power system and not the DG. When the LTC transformer/VR makes tapchanges the load side voltage changes instead of source side. In this case the LTC/VR controller operates in distributed generation mode where it ignores the reverse power and operates the tapchanger as normal (as though the power is flowing in the forward direction).

It is important to recognize the above two different operating modes and the inventive technique determines this mode automatically (Auto Determination) without the need for breaker/switch status information from the DG or the downstream recloser or switch. When the power measured by the LTC/VR controller shows it is going in the reverse direction (load side to source side) then the LTC/VR controller follows the following procedure to determine the mode of operation:

On the next tap operation, Load Voltage will be measured a short time (example 1 sec) before and a short time (example 1 sec) after the tap operation. The absolute voltage magnitude value of this difference shall be stored internally as Tap Delta Voltage.

a. If the Tap Delta Voltage is greater than a set value (example 0.4 V), the controller shall stay in Distributed Generation Mode and behave normally in this mode with no further measurements of Load Voltage needed.

b. If the Tap Delta Voltage is less than or equal to a set value (example 0.4 V), the control shall increment an internal counter designed to keep track of how many times the Tap Delta Voltage is less than 0.4V. The next tap operation will again measure Load Voltage in the same manner. If the control sees two consecutive Tap Delta Voltage measurements less than or equal to a set value (example 0.4 V), the control shall change from Distributed Generation Mode to Reverse Regulate mode where the raise and lower commands are reversed and the voltage from the source side of the LTC transformer/VR either measured directly or calculated using load voltage, tap position and the impedance of the series winding of the voltage regulator.

c. If Tap Delta Voltage is greater than a set value (example 0.4 V) on the second tap operation, the controller shall not increment the internal counter, shall stay in Distributed Generation Mode, and shall measure Tap Delta Voltage on the next tap. If that third tap has a Tap Delta Voltage greater than the set value (example 0.4 V), then the control shall remain in Distributed Generation Mode and shall clear the internal counter. If the third tap has a Tap Delta Voltage less than or equal to a set value (example 0.4 V), it will meet the requirements of item 'b' above and shall act accordingly.

Once the control has detected which Reverse Power mode it should be in using the method described above, it shall operate in that mode as long as Reverse Power is detected.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A system for controlling applied voltages comprising:

a power distribution system, the distribution system including a power generator and a load, the power generator delivering an applied voltage at a predetermined level to the load;

the power distribution system further including one or more of a load tap changing (LTC) transformer and a voltage regulator, the one or more LTC transformer and voltage regulator including tap selector switches, the tap selector switches selectively engaging a contact to lower the applied voltage, the tap selector switches reducing the applied voltage in set increments; and a LTC controller configured to control operation of the tap selector switches, the LTC controller establishing an upper band edge voltage, a lower band edge voltage, and a bandcenter that is midway between the upper and lower band edge voltages and a bandwidth is established as the difference between the upper band edge voltage and the lower band edge voltage, the LTC controller further configured to maintain the applied voltage between the upper and lower band edge voltages via the operation of the tap selector switches, wherein the LTC controller is further configured to temporarily disable the upper band edge voltage and temporarily designate the bandcenter as the upper band edge voltage whereby the tap selector switches operate in set increments to reduce the applied voltage to a level that is between the redesignated bandcenter and the lower band edge and reestablish the bandcenter to be midway between the upper and lower band edge voltages after the selector switches are operated.

2. The system recited in claim 1 wherein the LTC controller is configured to disable the lower band edge voltage and temporarily designate the bandcenter as the lower band edge voltage whereby the tap selector switches operate in set increments to increase the applied voltage to a level that is between the redesignated bandcenter and the upper band edge voltage.

3. The system recited in claim 1 wherein the LTC controller is a controller incorporating a microprocessor and memory.

4. The system recited in claim 3 wherein the microprocessor calculates the upper band edge voltage using the formula (bandcenter+bandwidth/2) and calculates the lower band edge voltage using the formula (bandcenter−bandwidth/2).

* * * * *